US006321475B1

(12) United States Patent
Glanz

(10) Patent No.: US 6,321,475 B1
(45) Date of Patent: Nov. 27, 2001

(54) SHELF-MOUNTED DISPLAY DEVICE

(75) Inventor: Andrew Glanz, Merrick, NY (US)

(73) Assignee: Natural Science Industries, Ltd., West Hempstead, NY (US)

( * ) Notice: Subject to any disclaimer, the term of this patent is extended or adjusted under 35 U.S.C. 154(b) by 9 days.

(21) Appl. No.: 09/592,767

(22) Filed: Jun. 13, 2000

(51) Int. Cl.[7] ..... G09F 3/18
(52) U.S. Cl. ..... 40/661; 248/220.41; 40/661.03
(58) Field of Search ..... 40/661, 661.11, 40/661.03; 248/220.41, 220.42; 211/193.003, 87.01, 88.01

(56) References Cited

U.S. PATENT DOCUMENTS

| | | | |
|---|---|---|---|
| 2,920,757 | 1/1960 | Garman | 206/45.21 |
| 3,027,064 | 3/1962 | Thomas | 226/43 |
| 3,570,665 | 3/1971 | Houston et al. | 206/78 |
| 3,881,649 | 5/1975 | Krautsack | 229/38 |
| 4,201,291 | 5/1980 | Davidson | 206/44 R |
| 5,480,090 | 1/1996 | Taddei et al. | 229/162 |
| 6,035,569 * | 3/2000 | Nagel et al. | 40/661.03 |

FOREIGN PATENT DOCUMENTS

WO 93/19448 * 9/1993 (WO) ..... 40/661.03

* cited by examiner

*Primary Examiner*—C. Davis
(74) *Attorney, Agent, or Firm*—Schweitzer Cornman Gross & Bondell LLP

(57) ABSTRACT

A display device for mounting to the front edge of a store shelf provides a sealed environment for display of an object. Preferably, the object is in a constructed craft item which may be assembled from a kit which is offered for sale and is located on the store shelf adjacent the display device. The displayed object serves as a promotional vehicle for the kit. The display device includes a bracket for mounting the display device to the shelf and a product display case mounted to the bracket. The product display case includes a shelf construction upon which the constructed object can be displayed and a protective dome surrounding the shelf construction. The shelf construction may have a friction fit with the protective dome and can include a forward wall adapted to support the object to be displayed.

11 Claims, 2 Drawing Sheets

2
12
14
22
24
26
3
12
12
10
2
16
18
30
3
50
48

24
12

SHELF-MOUNTED DISPLAY DEVICE

The present application relates to a new and improved display device particularly adapted for use in a retail store environment and to a business method incorporating the use of such a display device.

BACKGROUND OF THE INVENTION

The retail consumer is presented with an ever-increasing variety of goods offered to him or her in a retail store environment. Each of the goods vie for shelf space and the opportunity to be presented to the potential customer in an attractive manner and in a manner which will hopefully lead to a sale.

Such competition is present in the hobby and craft field as in other categories of goods. The products of various manufacturers compete with each other for shelf space and, once on the shelves, compete for the customer's purchase dollar. Consideration of closed packaging itself by the consumer often leads to ineffective competition. In connection with hobby and craft sets in particular a most effective and compelling promotion for the product can be the presentation of an actual product as made by the set. The display of an actual scale model airplane, for example, may be an effective inducement to a customer to buy the kit for completing that very model.

It is accordingly a purpose of the present invention to provide a display apparatus for presentation of three-dimensional objects in a retail store environment.

A further purpose of the present invention is to provide a display device for three-dimensional objects which may be associated with a retail store display of goods relating to the objects.

Still a further purpose of the present invention is to provide a display apparatus which may be mounted to a store shelf to provide a protected display environment for the objects to be displayed.

Yet another purpose of the present invention is to provide a methodology incorporating such a display apparatus for improving the sales appeal of kit products by allowing the display of an object constructed by the kit product.

BRIEF DESCRIPTION OF THE INVENTION

In accordance with the foregoing and other objects and purposes, a display device of the present invention includes a bracket assembly and a product display case construction affixed thereto. The bracket assembly is adapted to be mounted to a front edge of a shelf of the type which may be found in retail store environments and the like. The bracket assembly comprises a mounting wall and a rearwardly-extending flange projecting from the rear thereof. The product display case is supported by and extends forwardly of the mounting wall. The product display case includes a shelf which provides a support means upon which one or more three-dimensional objects, which may for example be samples of the type of construction which may be formed by a product offered for sale by the retail store, can be placed. The shelf is preferably adapted to accommodate the particular object or objects to be displayed. A transparent dome surrounds the shelf and the objects placed thereon to provide a closed and protected environment therefor. When in place on a store shelf, the display case is supported by the bracket assembly forwardly of the front shelf edge. Preferably, products for sale relating to the object placed in the display case are located on the store shelf in the immediate area, and preferably behind, the display device. The display device thus serves as an effective "shelf talker" for the goods for sale displayed in association therewith.

The methodology of the present invention contemplates the locating of one or more kit products on a store shelf, constructing an object in accordance with and from a kit product of the type placed on the shelf, and mounting the constructed object in a display device located at a front edge of the shelf upon which the kits are displayed.

BRIEF DESCRIPTION OF THE DRAWING

A fuller understanding of the present invention will be achieved upon consideration of the following, detailed description of a preferred, but nonetheless illustrative embodiment of the invention, when presented in association with the annexed drawings, wherein.

DETAILED DESCRIPTION OF THE INVENTION

Figure 1:
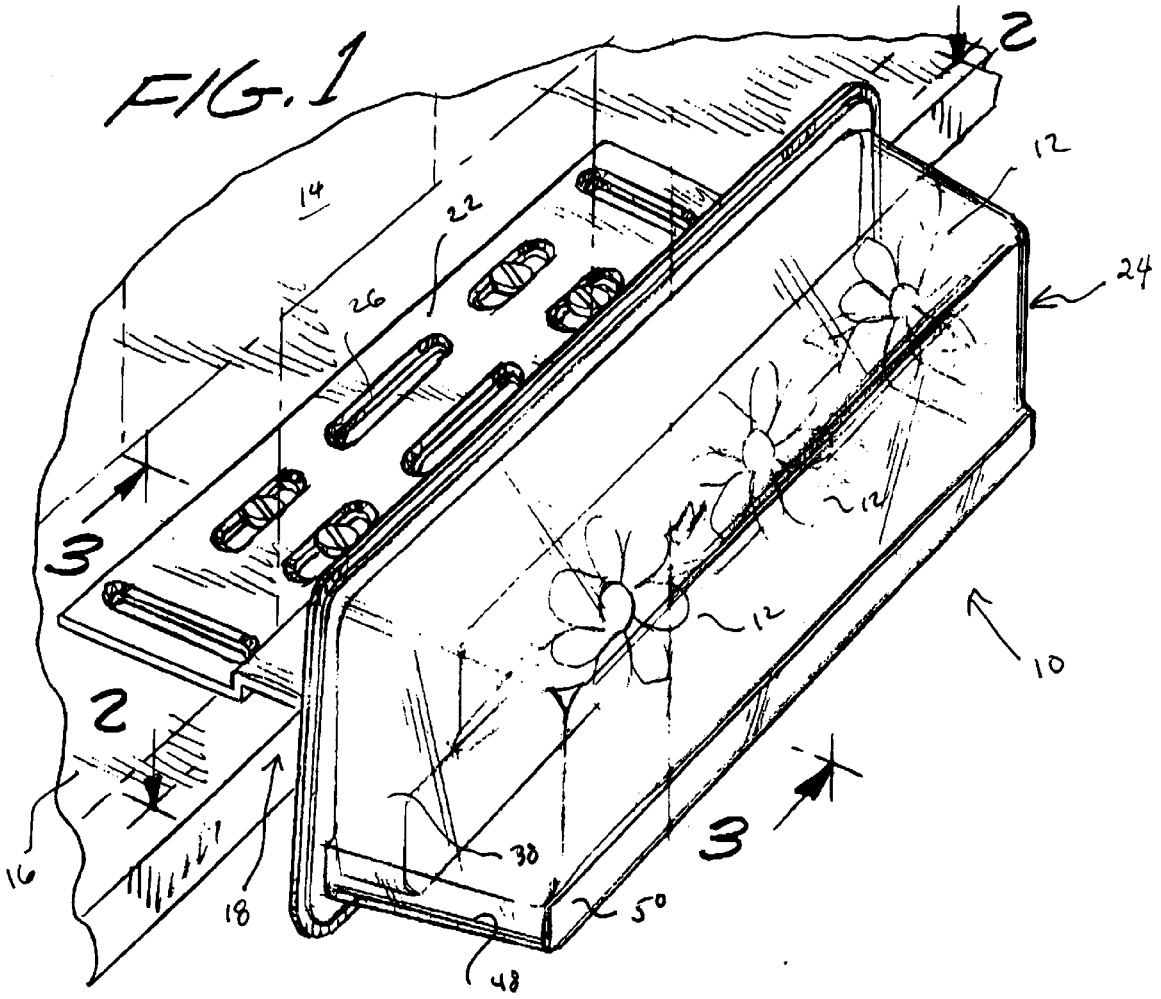
FIG. 1 is a perspective view of the invention mounted to a store shelf.
Figure 2:
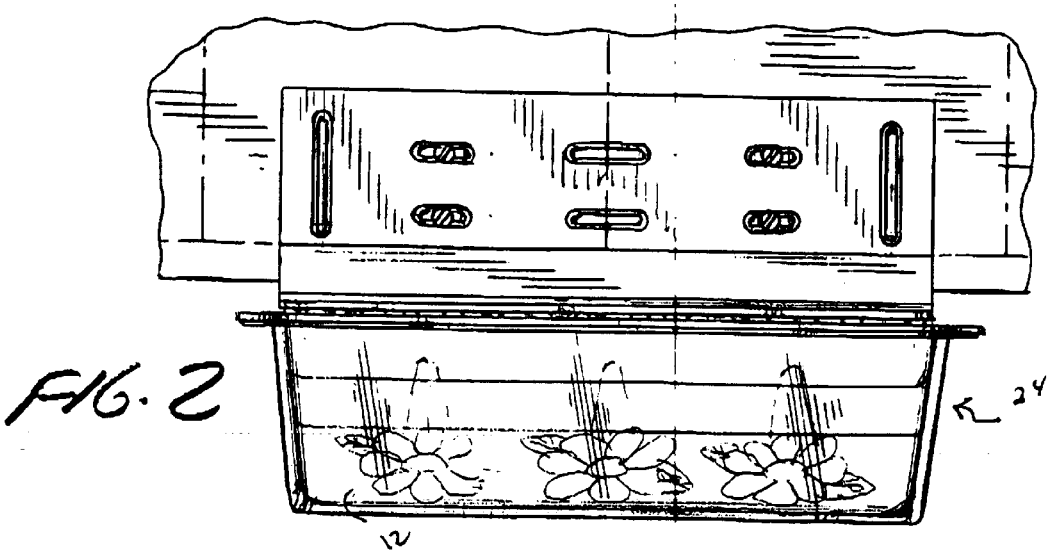
FIG. 2 is a top plan view thereof.
Figures 3, 4:
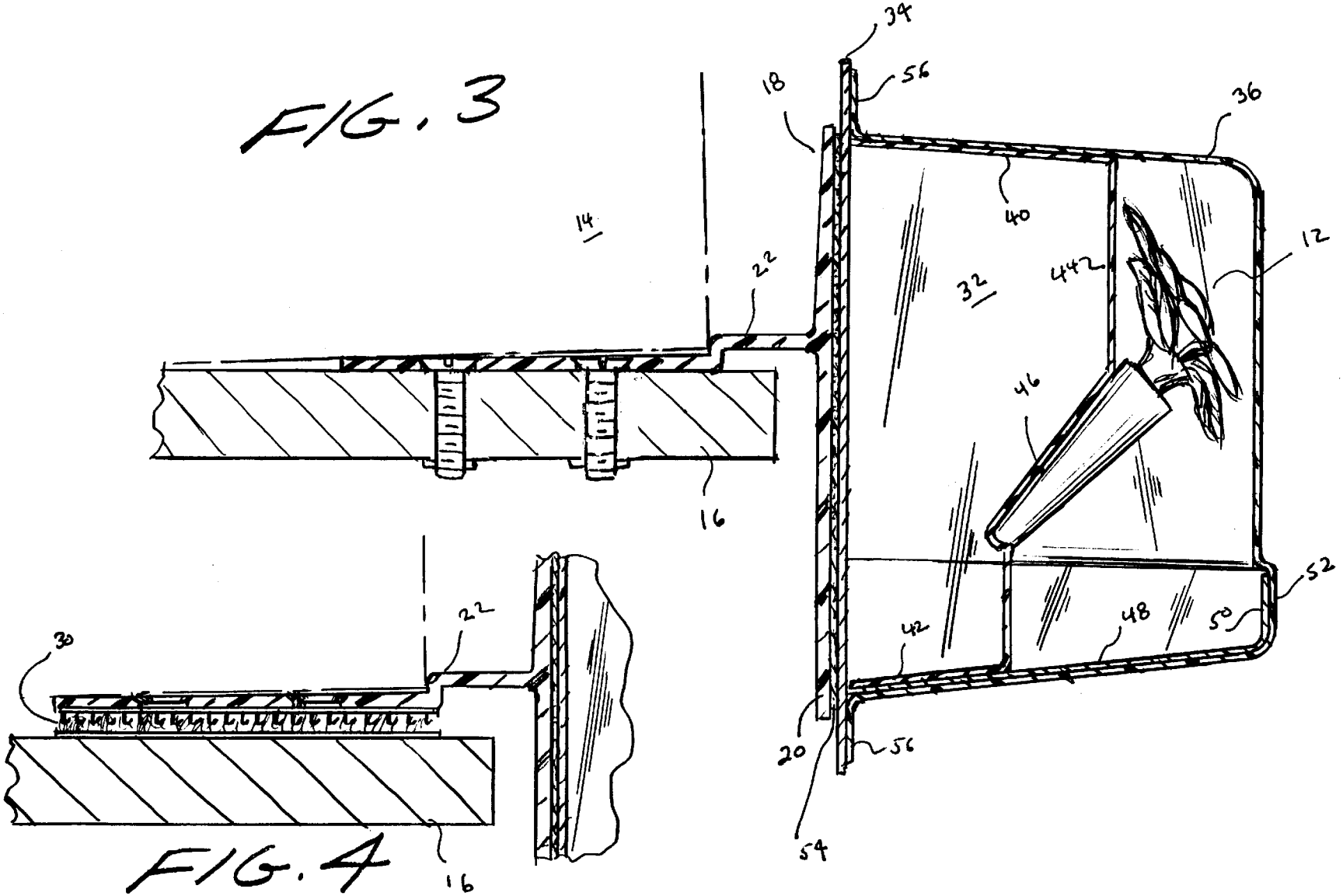
FIG. 3 is a section view taken along line 3—3 of FIG. 1.
FIG. 4 is a detail view depicting alternative mounting means for the invention.

With reference to FIGS. 1–3, display device 10 allows the presentation of one or more three-dimensional objects 12 in conjunction with products 14 (shown in phantom) offered for sale in a store environment on shelf 16. The display device 10 is constructed with a bracket assembly 18, which includes a wall portion 20 preferably extending vertically and a mounting flange 22 extending rearwardly therefrom, and an object display case construction 24 extending forwardly of the bracket assembly. The mounting flange 22 is so positioned such that the wall 20, and thus the display case, is supported in a cantilevered orientation positioned forwardly of the store shelf 16, vertically oriented both above and below the shelf.

The rear mounting flange 22 is of generally planar construction, extending along the length of the bracket element 18, although it may be provided with a slightly elevated front edge to avoid ridges and channels which may be found at the shelf front. The mounting flange is preferably provided with a plurality of mounting slots 26 which facilitate the fastening of the flange and thus the display device 10 to the store shelf. As store shelves often are constructed of a perforated material, the inclusion of a plurality of elongated mounting slots allow the alignment of a plurality of such slots with the perforations in the shelf to allow mounting bolts 28 to be utilized. Other alternative means of mounting may be utilized, as exemplified in FIG. 4, which presents the use of mating hook and loop fastener elements 30 mounted to the top surface of the shelf and the lower surface of the flange.

As perhaps best seen in FIG. 3, the bracket assembly 18 may comprise first and second unitary portions constructed from an appropriate plastic or other similar material, forming both wall portion 20 and rear mounting flange 22, respectively, for support of display case 24. The display case 24 in turn comprises a rear wall 34 to which is mounted a transparent dome 36 which affords an unobstructed view of the entire contents of the display case. Support means extends forwardly of the rear wall to support and display one or more objects to be displayed, such as artificial flowers 12, which may typically be crafted through use of the components of a product 14 with which the display is associated. As depicted, the support means may be configured as a display shelf insert 32 which fits snugly within the dome 36. As shown, the display shelf 32 has side walls 38 (see FIG. 1), a top wall 40, and a bottom wall 42, which fit snugly against corresponding portions of the transparent dome 36. As may be seen, the dome 36 is slightly tapered from back to front, a similar taper being applied to the walls of the display shelf and which facilitate a frictional inter-engagement between the respective dome and display shelf 32 to support the display shelf in position. As further depicted, the display shelf 32 may include a forward wall 44 having means for supporting and displaying the objects 12. The forward wall may be generally vertical, as shown. As depicted in the figures, the object support and display means may comprise slots or recesses 46 into which the objects may be mounted. Adhesive or other means may be provided to assist in retaining the objects within the slots. Alternatively, the objects may be directly mounted by adhesive or strap means to the wall. Still further, the display shelf 32 may be otherwise configured for support of objects, and may include, for example, in addition to or in place of the vertical wall 44, a horizontal ledge portion upon which the objects may be presented.

In the embodiment depicted in the Figures, the display objects 12 are mounted in the support means 46 of the display shelf, which is then inserted within the dome 36. The shelf and dome subassembly is then mounted to the rear wall 34, typically by use of an appropriate adhesive. The resulting assembly is then affixed to the bracket element 18, again preferably with an adhesive 54. The dome 36 may have a rear peripheral flange 56 to facilitate mounting upon the bracket element.

Because both the dome and product display shelf are preferably of a transparent molded plastic, the forward face of the rear wall 34 can be seen through the dome and shelf. Accordingly, attractive indicia may be provided thereon to identify the objects displayed as well as associate the objects with a product on the shelf. Alternatively, however, the vertical wall 44 of the display shelf can be opaque, and bear design indicia. While the displayed objects are in full view of a potential buyer, who can inspect them from varying observation points as a result of a transparent nature of the dome, the use of a permanent adhesive between the dome and rear wall 34, as well as a permanent affixation of the rear wall 34 to the bracket element 18, insures that the objects remain protected from inadvertent harm or damage. A display card 48, having an upturned front edge 50 which rests against the lower portion of the front face of the dome may be employed to further present informational indicia or information to the public. The dome may be formed with a forwardly-extending bulge portion 52 to accommodate the upturned edge 50 and assist in retaining the display card in position. Further, retention means for the card may be provided by the display shelf bottom wall 42, which overlies the rear portion of the display card and holds the card in place between the bottom wall 42 and the rear portion of the dome.

I claim:

1. A shelf-mountable display device, comprising:

a shelf mounting bracket element having a vertical wall and a rearwardly-extending mounting flange;

means engageable with said mounting flange for affixing the bracket element to a front edge area of a shelf; and a product display case further having a rear wall mounted to said vertical wall, said display case comprising a product support means extending forwardly of the bracket element vertical wall and a clear dome coupled to said vertical wall endosing said product support means.

2. The display device of claim 1, wherein said product support means comprise a product display shelf.

3. The display device of claim 2, wherein, said clear dome is mounted to the rear wall.

4. The display device of claim 3, wherein said product display shelf further includes a forward wall having product support means.

5. The display device of claim 4, wherein said product display shelf forward wall extends between top and bottom walls of the product display shelf.

6. The display device of claim 2, wherein said product display shelf and dome each include interfitting peripheral walls.

7. The display device of claim 6 further including a display card having an upturned front edge adjacent a lower portion of a front surface of the dome and a rear portion located between a bottom wall of said product display shelf and an interfitting peripheral wall portion of said dome.

8. The display device of claim 7, wherein the lower portion of the front surface of the dome is in the form of a bulge to accommodate the upturned front edge portion.

9. The display device of claim 1 further including a display card having an upturned front edge portion positioned adjacent a lower portion of a front surface of said dome.

10. The display device of claim 9, wherein the lower portion of the front surface of the dome is in the form of a bulge to accommodate the upturned front edge portion.

11. The combination of:

a shelf;

at least one kit package for constructing at least one craft project object removable located upon said shelf; and a display device mounted to a front edge of the shelf adjacent said at least one kit package and comprising a shelf mounting bracket element having a vertical wall and a rearwardly-extending mounting flange; means engageable with said mounting flange for affixing the bracket element to a front edge area of a shelf; and a product display case mounted to said vertical wall, said display case further comprising a product display shelf having wall for display of at least one of the craft projects constructable by said kit package extending forwardly of the bracket element of the wall and a clear dome enclosing said product display shelf and coupled to said vertical wall.

* * * * *